US006783381B2

(12) United States Patent
Fukuda

(10) Patent No.: US 6,783,381 B2
(45) Date of Patent: Aug. 31, 2004

(54) WATER-PROOF CONNECTOR AND CONNECTOR HOUSING THEREFOR

(75) Inventor: Eiji Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/274,045

(22) Filed: Oct. 21, 2002

(65) Prior Publication Data

US 2003/0077939 A1 Apr. 24, 2003

(30) Foreign Application Priority Data

Oct. 22, 2001 (JP) ..... 2001-323916

(51) Int. Cl.[7] ..... H01R 13/52
(52) U.S. Cl. ..... 439/271
(58) Field of Search ..... 439/271, 272, 439/273, 275, 276

(56) References Cited

U.S. PATENT DOCUMENTS

| | | | | |
|---|---|---|---|---|
| 5,336,101 A | | 8/1994 | Kasugai et al. | 439/272 |
| 5,399,045 A | * | 3/1995 | Yoneda et al. | 403/321 |
| 5,545,048 A | | 8/1996 | Maeda | 439/273 |
| 5,709,563 A | | 1/1998 | Saito | 439/275 |
| 6,332,800 B2 | * | 12/2001 | Kodama | 439/357 |
| 6,443,764 B2 | * | 9/2002 | Makita | 439/587 |
| 6,527,578 B2 | * | 3/2003 | Kashiyama et al. | 439/352 |
| 6,582,242 B2 | * | 6/2003 | Murakami et al. | 439/271 |

FOREIGN PATENT DOCUMENTS

| | | |
|---|---|---|
| EP | 0 727 844 | 8/1996 |
| EP | 1 009 065 | 6/2000 |
| EP | 1 091 453 | 4/2001 |

OTHER PUBLICATIONS

Copy of British Patent Office Communication and Search Report for corresponding British Patent Application GB 0223328.6 dated Jan. 30, 2003.

* cited by examiner

*Primary Examiner*—Chandrika Prasad
(74) *Attorney, Agent, or Firm*—Armstrong, Kratz, Quintos, Hanson & Brooks, LLP

(57) ABSTRACT

A waterproof connector consists of a female housing 2 and a male housing 3 which are to be coupled with other. The male housing 3 includes a body 15 accommodating female terminals, a cover 15 and a packing 39. The cover 23 includes a plurality of peripheral walls 24 and a wall 50. The wall 50 has a recess 52. A protrusion 53*a* is provided at the inner edge of the recess 52 close to a packing 39. The protrusion 53*a* protrudes from the inner edge of the recess 52 close to the packing 39 toward the female housing. The protrusion 53*a* is arranged between the recess 52 and packing 39. The one end 39*a* of the packing 39 is located between the protrusion 53*a* and the body 15. In this configuration, the waterproof connector can prevent water from permeating into a contact portion between terminal metal fittings.

6 Claims, 9 Drawing Sheets

WATER-PROOF CONNECTOR AND CONNECTOR HOUSING THEREFOR

BACKGROUND OF THE INVENTION

1. Field of the Invention

This invention relates to a water-proof connector which is used for connection of an electric wire and a connector housing for the water-proof connector.

2. Description of the Related Art

A wire harness used for a motor vehicle which is a moving body includes a connector composed of a male-type connector housing (hereinafter referred to as a male housing), a female-type connector housing (hereinafter referred to as a female housing), which are connector-coupled with each other. The male connector housing and the female connector housing each incorporates a wire-equipped terminal fitting. When the male housing and female housing are coupled to each other, the wire-equipped terminal fittings are brought into electric contact with each other.

As the above connector, a water-proof connector is used to prevent water from invading a contact portion where the terminal fittings are in contact with each other. The water-proof connector includes the male housing, female housing and a packing serving as a sealing material. The male housing integrally includes a tube and a body which incorporates the terminal fitting. The body is accommodated inside the tube. The female connector is formed in a tube-like shape and accommodates a terminal fitting.

The body of the male housing advances into the female housing and the female housing advances into the tube of the male housing so that the male housing and female housing are coupled with each other. The packing is attached to the outer periphery of the body. The packing is made of resin having elasticity such as rubber. When the housings are coupled with each other, the packing is brought into intimate contact with the inner face of the female housing so that the outer face of the body and inner face of the female housing are kept watertight therebetween.

The above waterproof connector is provided with a through-hole for outwardly dissipating water having invaded the inside of the tube of the male housing. The through-hole penetrates through the tube of the male housing, and communicates the space inside the tube and outside the body with the outside of the male housing.

As the case may be, the waterproof connector is attached to an engine room, and the motor vehicle is washed by pouring pressurized water (high-pressure washing). When the motor vehicle is subjected to the high-pressure washing, the pressurized water may invade the male housing through the through-hole. At this time, the pressurized water may directly bump the packing through the though-hole (without being decompressed).

In this case, owing to the pressure of water, the packing is elastically deformed in a direction leaving from the inner face of the female housing so that the water may invade between the female housing and the packing. The water may touch with the area where the terminal fittings are in contact with each other. Thus, the conventional water-proof connector may lead to incomplete water-proof when the motor vehicle is subjected to the high pressure washing.

SUMMARY OF THE INVENTION

Accordingly, a first object of this invention is to provide a water-proof connector which can surely prevent water from invading an area where terminal fittings are in contact with each other. A second object of this invention is to provide a connector housing of a water-proof connector which can surely prevent water from invading an area where its terminal fitting is in contact with a terminal fitting of a complementary connector housing.

In order to attain the above first object, in accordance with this invention, there is provided a water-proof connector composed of a connector housing and a tube-like complementary connector housing which are coupled with each other, wherein the connector housing comprises:

- a tube into which the connector housing is to be inserted;
- a body accommodated in the tube and incorporating a terminal fitting;
- a seal attached to an outer face of the body, which keeps watertight a space between an outer face of the body and an inner face of the complementary connector housing;
- a through-hole communicating a space outside the body and inside the tube with an outside of the tube and passing through the tube; and
- a protrusion which protrudes from an inner edge of the through-hole close to the seal toward the complementary connector housing and located between the through-hole and the seal.

In accordance with the water-proof connector described above, a through-hole communicates a space outside the body and inside the tube with an outside of the tube. Therefore, the liquid such as water invaded the tube of the connector housing can be relieved to the outside of the connector housing through the through-hole.

Further, a protrusion protrudes from an inner edge of the through-hole close to the seal toward the complementary connector housing and is located between the through-hole and the seal. Therefore, the liquid such as water which invades the connector housing through the through-hole bumps against the protrusion.

In the water-proof connector of this invention, preferably, when the connector housing and the complementary connector housing are coupled with each other, the protrusion and the complementary connector housing are brought into contact with each other.

In accordance with the water-proof connector just above, when the connector housing and the complementary connector housing are coupled with each other, the protrusion and the complementary connector housing are brought into contact with each other. Therefore, the liquid such as water which invades the connector housing through the through-hole does not directly bump the seal.

In the water-proof connector of this invention, preferably, at least a part of the seal is located between the protrusion and the body.

In accordance with the water-proof connector of this invention described just above, at least a part of the seal is located between the protrusion and the body. Therefore, the liquid such as water which invades the connector housing through the through-hole bumps against the protrusion but does not surely bump the seal.

In order to attain the second object, in accordance with this invention, there is provided a connector housing of a water-proof connector of this invention described in claim 4 is a connector housing of a water-proof connector to be coupled with a tube-like complementary connector housing, wherein the connector housing comprises:

a tube into which the connector housing is to be inserted;

a body accommodated in the tube and incorporating a terminal fitting;

a seal attached to an outer face of the body, which keeps watertight a space between an outer face of the body and an inner face of the complementary connector housing;

a through-hole communicating a space outside the body and inside the tube with an outside of the tube and passing through the tube; and a protrusion which protrudes from an inner edge of the through-hole close to the seal toward the complementary connector housing and located between the through-hole and the seal.

In accordance with the connector housing for a water-proof connector of this invention described above, a through-hole communicates a space outside the body and inside the tube with an outside of the tube. Therefore, the liquid such as water invaded the tube of the connector housing can be relieved to the outside of the connector housing through the through-hole.

Further, a protrusion protrudes from an inner edge of the through-hole close to the seal toward the complementary connector housing and is located between the through-hole and the seal. Therefore, the liquid such as water which invades the connector housing through the through-hole bumps against the protrusion.

In the connector housing of a water-proof connector of this invention, preferably, when the connector housing and the complementary connector housing are coupled with each other, the protrusion and the complementary connector housing are brought into contact with each other.

In accordance with the connector housing of a water-proof connector of this invention described just above, when the connector housing and the complementary connector housing are coupled with each other, the protrusion and the complementary connector housing are brought into contact with each other. Therefore, the liquid such as water which invades the connector housing through the through hole does not directly bump the seal.

In the connector housing of a water-proof connector of this invention, preferably, at least a part of the seal is located between the protrusion and the body.

In accordance with the connector housing of a water-proof connector of this invention described just above, at least a part of the seal is located between the protrusion and the body. Therefore, the liquid such as water which invades the connector housing through the through-hole bumps against the protrusion but does not surely bump the seal.

The above and other objects and features of this invention will be more apparent from the following description taken in conjunction with the accompanying drawings.

DESCRIPTION OF THE PREFERRED EMBODIMENTS

Figure 1:
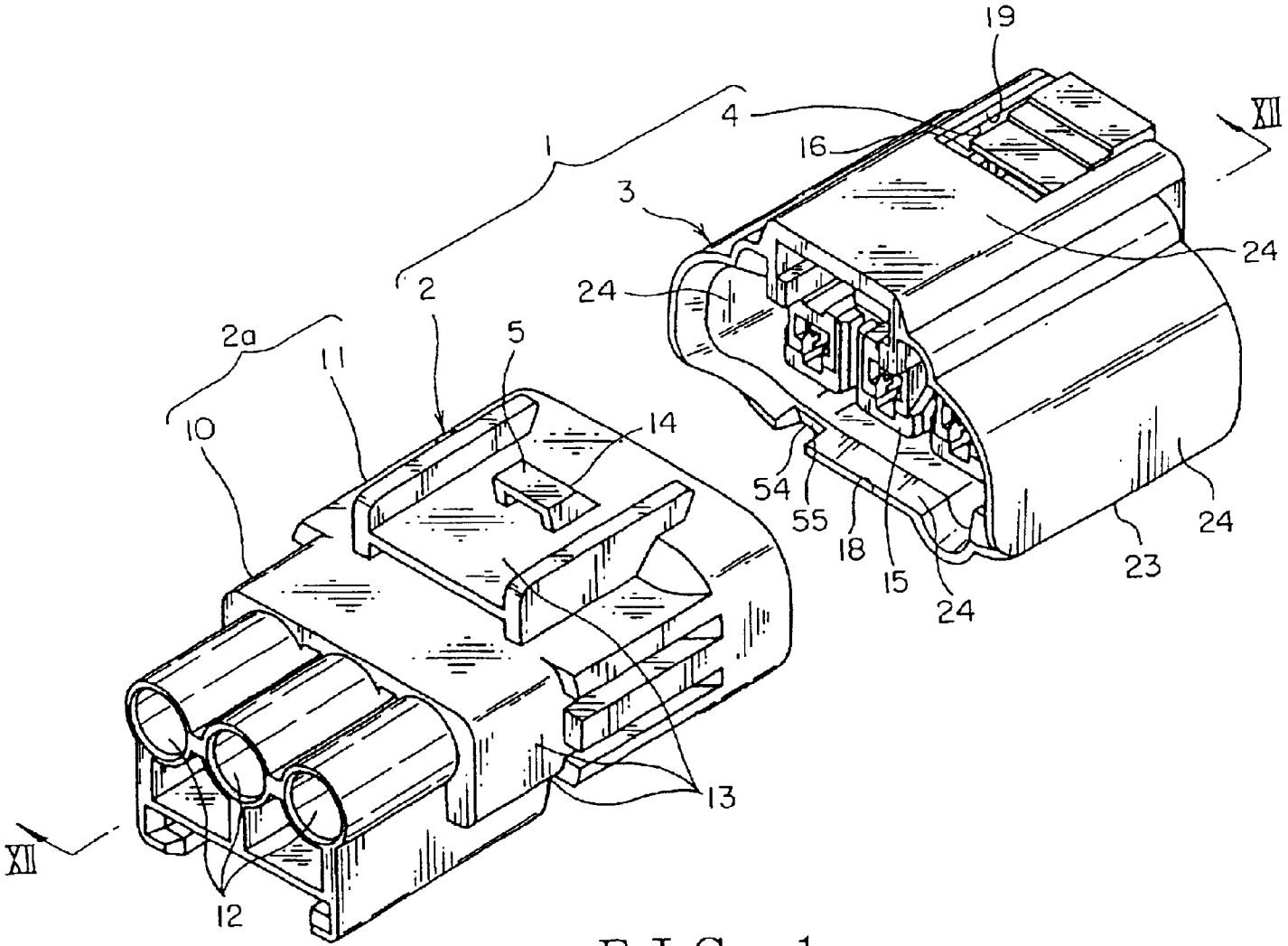
FIG. 1 is an exploded perspective view of a waterproof connector according to an embodiment of this invention.
Figure 2:
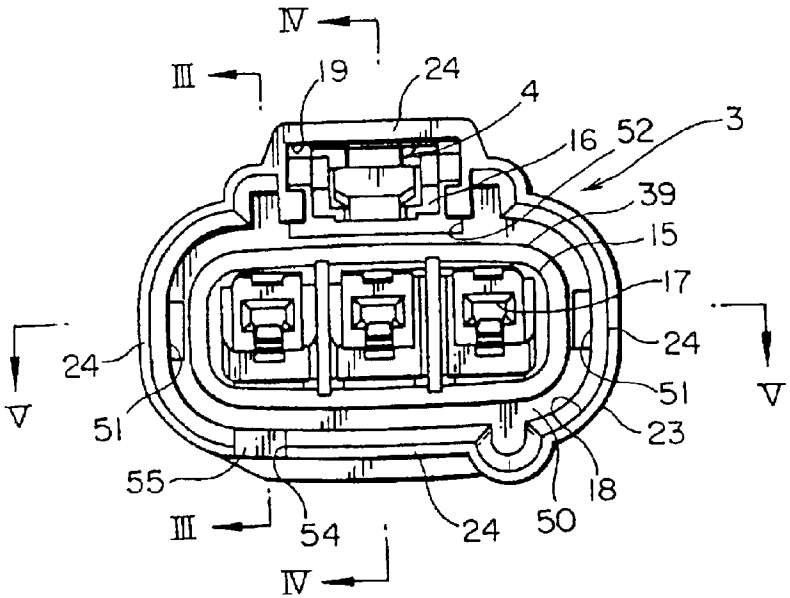
FIG. 2 is a front view of the male housing of a waterproof connector shown in FIG. 1.
Figure 3:
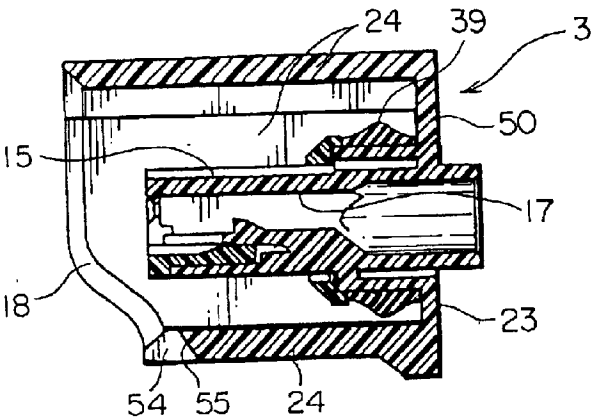
FIG. 3 is a sectional view taken in line III—III in FIG. 2.

Now referring to FIGS. 1 to 21, an explanation will be given of the water-proof connector according to an embodiment of this invention. A water-proof connector 1 as shown in FIG. 1 constitutes a wire harness arranged in a motor vehicle. As seen from FIGS. 1 and 12 to 17, the water-proof connector 1 includes a tubular female connector housing 2 (hereinafter referred to as a female housing) which serves as a complementary connector housing in the specification, a male connector housing 3 (hereinafter referred to as a male housing) which serves as a pertinent connector housing, and a locking assuring member 4.

The female housing 2 is made of synthetic resin. As seen from FIGS. 1 and 12 to 17, the female housing 2 is provided with a housing body 2*a*. The housing body 2*a* includes a body 10 and a tubular cover 11. In this specification, the connector housing which is formed in a tubular shape and incorporates a body of the male housing 3 serves as the female connector housing.

Figure 12:
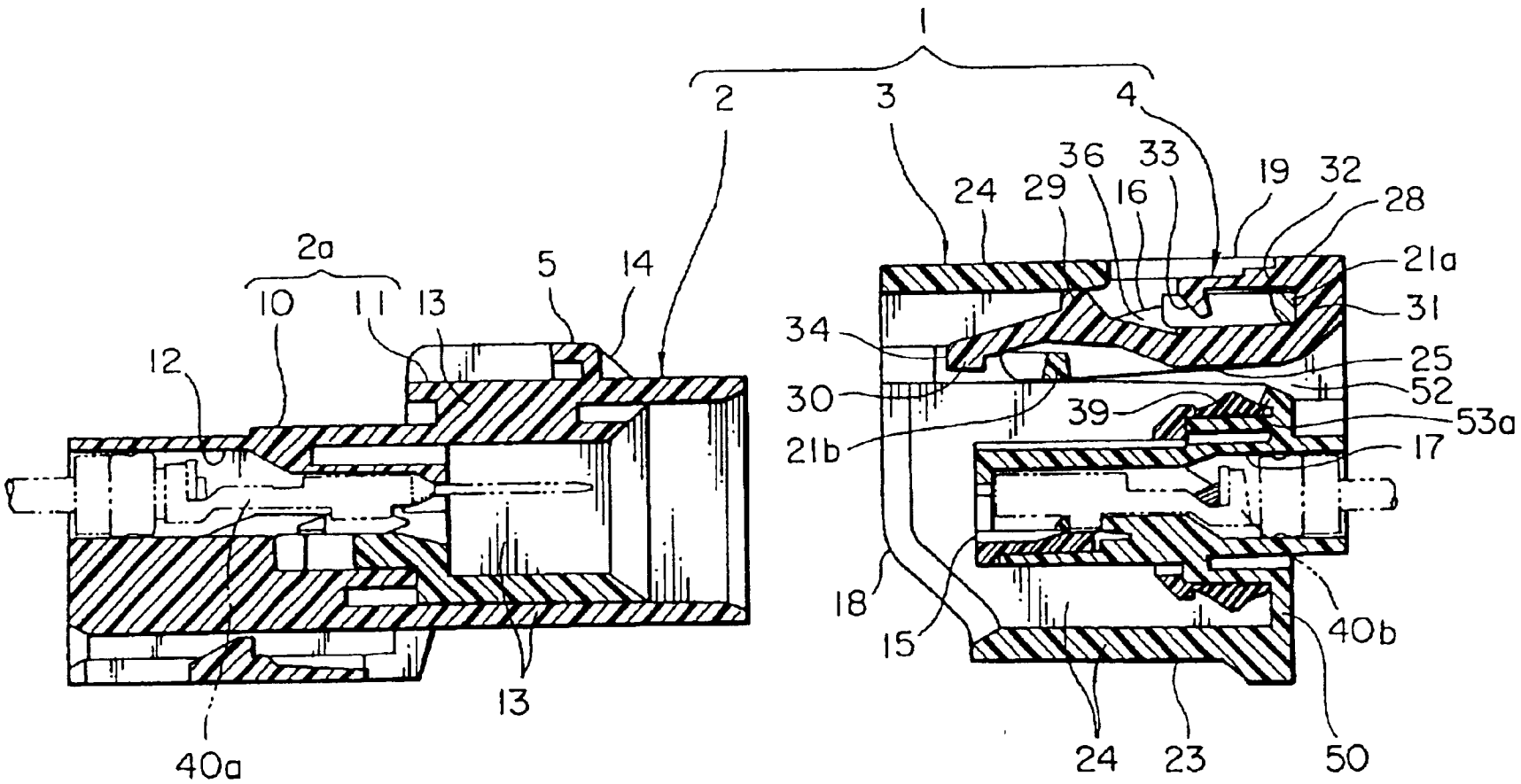
FIG. 12 is a sectional view taken in line XII—XII in FIG. 1.

The body 10, as seen from e.g. FIG. 12, accommodates a plurality of male terminal fittings (male terminals). The body 10 includes a plurality of terminal chambers which are arranged in parallel. The terminal chambers 12 each extends linearly to accommodate the male terminal 40*a*.

The cover 11 receives the body 15 of the male housing 3 described later inside itself. The cover 11 has a plurality of peripheral walls which communicate with the outer edges of the body 10, respectively, and is formed in a box shape. Namely, the cover 11 communicates with the body 10. The edges far from the body 10 of the peripheral walls 13 constitute an opening for receiving the body 15 of the male housing 3.

A locking protrusion 5, which serves as a locking securing portion, is formed on one of the peripheral walls 13 which is located on the upper side of the cover 11 as shown. The locking protrusion 5 protrudes from the outer surface of the above one of the peripheral walls 13. The locking protrusion 5 is located on the peripheral wall 13 centrally in both directions of the width and length thereof.

The locking protrusion 5 has a tapered face 15 at its end close to the opening. The tapered face 14 slopes from both directions of the outer surface of the peripheral wall 13 and plane orthogonal thereto so that it gradually leaves from the opening as it leaves from the peripheral wall 13. The locking protrusion 5 is to be engaged in a locking hole 36 of a locking arm 16 described later.

The male housing 3 is made of synthetic resin. As seen from FIGS. 2 to 5 and 12 to 17, the male housing 3 includes the body 15, a cover 23 formed in a tubular shape, a locking arm 16 and a packing 39 which serves as a sealing member. In this specification, the connector housing having the body 15 which is to be inserted into the tubular female housing 2 is referred to as the male connector housing.

The body 15, which is formed in a tubular shape, accommodates a plurality of female terminal fittings 40*b* (hereinafter referred to as female terminals) as seen from FIG. 12. The body 15 has a plurality of terminal chambers 17 which are arranged in parallel. The terminal chambers 17 each extends linearly to accommodate the above female terminal 40*b*. The body 15 is inserted into the cover 11 so that the terminal chambers 17 are successive to the terminal chambers 12 of the female housing 2, respectively.

The cover 23 is formed in a shape of a box (tube) provided with a plurality of peripheral walls 24. The male housing 3 is formed in a tubular shape. The cover 23 accommodates the body 15 inside itself.

The peripheral walls 24 are flat in a longitudinal direction of the female terminals 40*b* which are accommodated in the body 15. The one ends of the plurality of peripheral walls 24 which constitute the cover 23 (i.e. the one end of the cover 23) constitute an opening 18 for receiving the female housing 2. The other ends of the peripheral walls 24 (end of the cover 23) is successive to a wall 50. Thus, the wall 50 blocks the other end of the cover 23.

The wall 50 is successive to the outer edge of the body 15. The wall 50 extends outwardly from the body 15. The wall 50 has a pair of holes 51 and a recess 52. These holes 51 and recess 52, as seen from FIGS. 2, 7 and 8, penetrate through the wall 50. Therefore, the holes 51 and recess 52 communicate the space outside the body 15 and inside the cover 23 with the space outside the cover 23.

The pair of holes 51 are arranged apart from each other in a width direction of the male housing 3. The pair of holes 51 are arranged in the vicinity of the pair of peripheral walls 24 which are opposite to each other in the width direction of the male housing 3. As seen from FIGS. 5 and 6, the inner faces of the pair of holes 51 are flush with those of the pair of peripheral walls 24 which are opposite to each other in the width direction of the male housing 3. The recess 52 is arranged in the vicinity of the peripheral wall 24 on an upper side as shown. The recess 52 is successive to a recess 19 described later. These pair of holes 51 and recess 52 are used to exhaust the liquid such as water permeated in the cover 23. These pair of holes 51 and recess 52 constitute the through-holes in the specification.

The peripheral walls 24 are formed to become gradually thin toward the opening 18. The recess 19 is formed in the one of the peripheral walls 24 on the upper side as shown. The recess 19 penetrates through the peripheral wall 24.

Further, the cover 23, i.e. the male housing 3 is provided with a plurality of protrusions 53. In the illustrated example, the male housing 3 is provided with three protrusions 53. As seen from FIGS. 4 and 12 to 17, the one (hereinafter denoted by reference numeral 53*a*) of the three protrusions 53 protrudes from the wall 50, which is located at the inner edge of the recess 52 close to the body 15, i.e. the packing 39, inwardly in the longitudinal direction of the female terminal 40*b* in the male housing 3 and also outwardly of the male housing 3.

This refers to that the protrusion 53*b* protrudes from the inner edge of the recess 52 close to the packing 39. Further, when the housings 2 and 3 are coupled with each other, the protrusion 53*a* protrudes towards the female housing 2 from the inner edge close to the packing 39 of the recess 52. Further, in this case, as seen from FIG. 20, the protrusion 53*a* is opposite to the edge of the peripheral wall 13 of the female housing 2 so that the former is apart from the latter.

Figure 6:
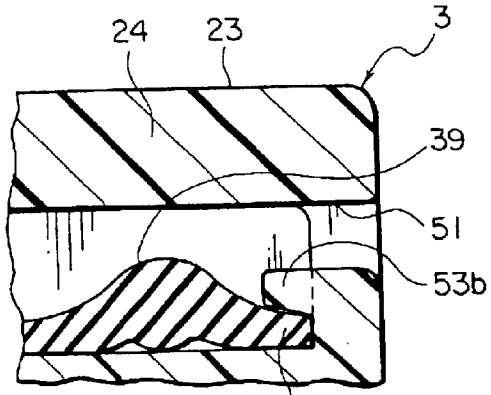
FIG. 6 is an enlarged sectional view of a IV portion in FIG. 5.
Figure 5:
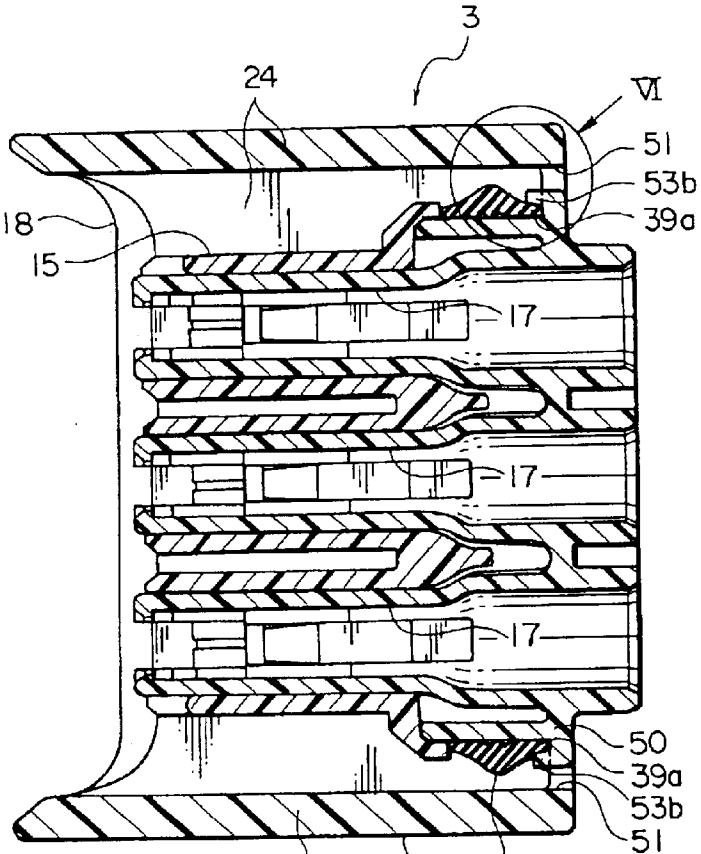
FIG. 5 is a sectional view taken in line V—V in FIG. 2.
Figure 10:
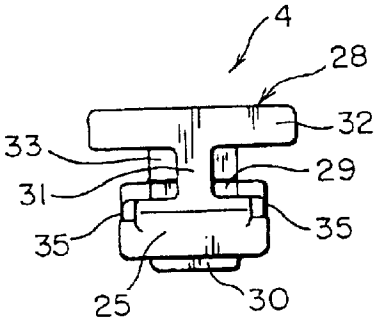
FIG. 10 is a front view of the locking assuring member when viewed in a direction of arrow X in FIG. 9.

The other two protrusions (denoted by 53*b*) of the three protrusions 53, as seen from FIGS. 5 and 6, each protrudes from the wall 50 located at the inner edge close to the body 15 (i.e. packing 31) of the hole 51 inward of the cover 23, i.e. the male housing 3 in the longitudinal direction of the female terminal 40*b*. In this specification, this refers to that the protrusion 53*b* protrudes from the inner edge of the hole 51 close to the packing 39. Further, when the housings 2 and 3 are coupled with each other, the protrusion 53*b*, as seen from FIG. 21, protrudes from the inner edge of the hole 51 close to the packing 39 toward the female housing 2.

The three protrusions 53*a* and 53*b* each locates the one end 39*a* close to the wall 50 of the packing 39 (FIGS. 20 and 21) between itself and the body 15. Further, along arrows K1 and K2 in FIGS. 20 and 21, the protrusions 53*a* and 53*b* are arranged between the recess 52 and hole 51 and the packing 39, respectively. Incidentally, the arrows K1 and K2 refer to the direction crossing the direction where these housings 2 and 3 approach each other when they are coupled with each other.

In the peripheral wall 24 on the lower side as shown, a recess 54 is formed. The recess 54 serves to prevent an female housing 2 with an erroneous product number from invading the cover 23 of the male housing 3. The recess 54 is formed in a concave shape from the edge of the peripheral wall 24 which constitutes an opening. Therefore, the recess 54 notches the edge of the cover 23 close to the female housing 2.

Figure 4:
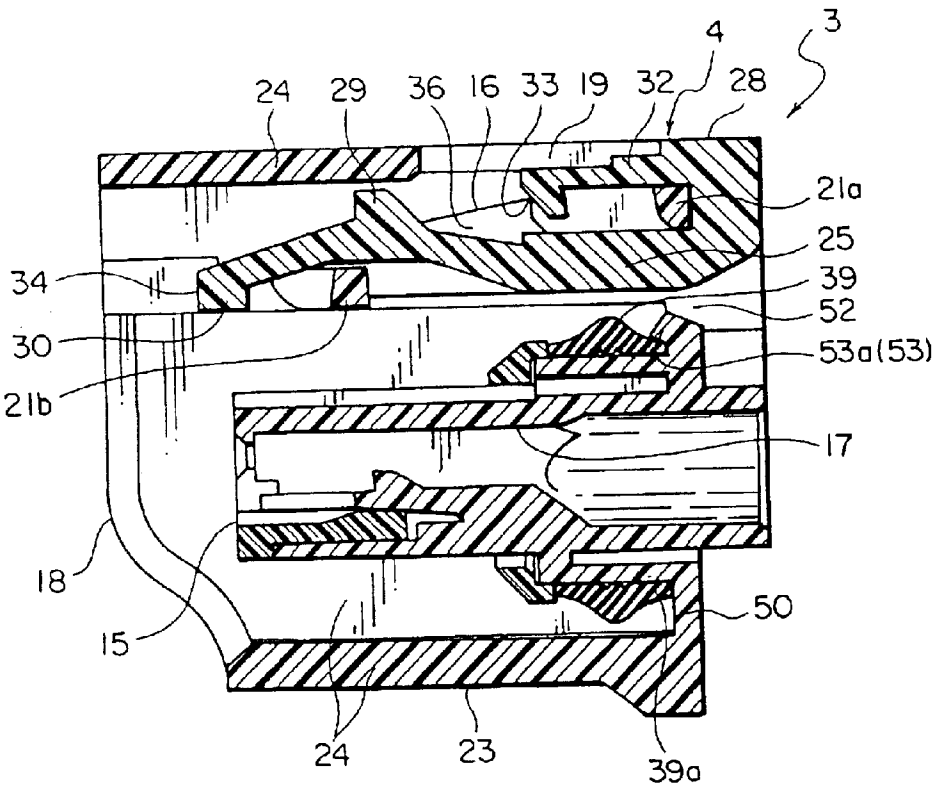
FIG. 4 is a sectional view taken in line IV—IV in FIG. 2.

The face opposite to the above protrusion, i.e. female housing 2 of the recess 54, as seen from FIG. 4, gradually slopes toward the outside of the male housing 3 as it leaves from the opening 18, i.e. the female housing 2. The face 55 slopes from the direction where the female housing 2 and male housing 3 approach each other when they are coupled with each other.

Figure 11:
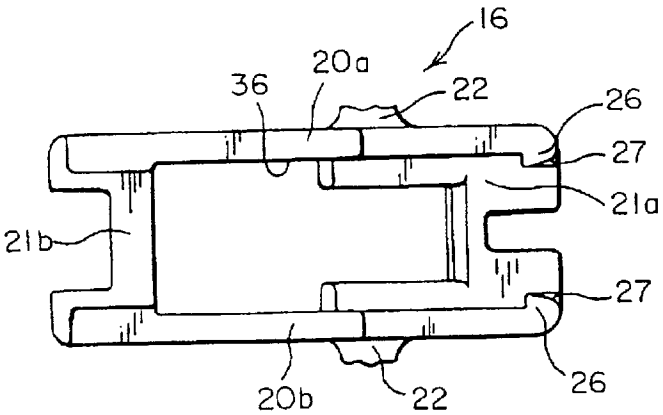
FIG. 11 is a plan view of a locking arm shown in FIG. 1, when viewed from below.

The locking arm 16 is made of synthetic resin and resilient. The locking arm 16, as seen from FIG. 11, is formed as a frame including a pair of first bar members 20*a* and 20*b* and a pair of second bar members 21*a* and 21*b*. The first bar members 20*a* and 20*b* are arranged in parallel apart from each other. The second bar member 21*a* and 21*b* are shorter than the first bar members 20*a* and 20*b* and also arranged in parallel apart from each other. The second bar members 21*a* and 21*b* couple the opposite ends of the pair of first bar members 20*a* and 20*b* with each other.

The locking arm 16 is arranged inside the cover 23. The locking arm 16 is arranged between the peripheral wall 24 with the recess 19 and the body 15. The longitudinal direction of the locking arm 16 is in parallel to that of the terminal chamber 17, i.e. female terminal 40*b*. The longitudinal direction of the locking arm 16 is the same as the direction where the housings 2 and 3 approach each other when they are coupled with each other. The locking arm 16 is provided with a pair of supporting pieces 22 (FIG. 11) at a center in the longitudinal direction.

The supporting pieces 22 are integral to both edges of the locking arm 16 in the width direction. The supporting pieces are successive to the edges of the locking arm 16 and to the inner face of the cover 23. The supporting pieces 22 are resilient. Therefore, the locking arm 16 is shiftably supported to the cover 23 around the center in the longitudinal direction. Namely, when the supporting pieces 22 are elastically deformed, the center in the longitudinal direction of the locking arm 16 does not almost shift relatively to the cover 23 and both ends in the longitudinal direction of the locking arm 16 shift relatively to the cover 23.

As seen from FIG. 11, the pair of first bar members 20*a* and 20*b* are provided with lugs 26 at their ends far from the opening 18, respectively. The lugs 26 protrude in a direction where they approach each other from the ends. The lugs 26 have slopes 27 at their ends far from the opening 18. The slopes 27, as they are nearer to the opening 18 or female housing 2, slope in both longitudinal and width direction so that they gradually go inwards of the locking arm 16.

The inside of the locking arm 16 constitutes a locking hole 36. The locking protrusion 5 invades the locking hole 36 so that the locking protrusion 5 is engaged with the locking hole 36. Thus, the locking protrusion 5 can be engaged with the locking arm 16.

The packing 39 is made of synthetic resin which can be elastically deformed. The packing 39 is ring-shaped. The packing 39 causes the body 15 to pass inside itself. The packing 39 is attached to the entire outer face of the body 15. When the housings 2 and 3 are coupled with each other, the packing 39 is brought into intimate contact with both the outer face of the body 15 and the inner face of the peripheral wall 13 of housing 2. The packing 39, when the housings 2 and 3 are coupled with each other, keeps watertight the space between the outer face of the body 15 and the inner face of the peripheral wall 13 of the female housing 2.

The locking assuring member 4 is made of synthetic resin which can be elastically deformed. As seen from FIGS. 9 and 10, the locking assuring member 4 includes a member body 25 formed in an arm shape, an attaching portion 28, a contact portion 30 and protrusion 29.

The member body 25 in a direction where the housings 2 and 3 approach each other is passed through the inside of the locking hole 36. The one end of the member body 25 far from the opening 18 is arranged between the body 15 and the second bar member 21*a* of the pair of second bar members 21*a* and 21*b* far from the opening 18.

The other end of the member body 25 close to the opening 18 is arranged between the peripheral wall 24 and the second bar member 21*b* close to the opening 18 of the pair of second bar members 21*a* and 21*b*. In short, the member body 25 is passed through the locking hole 36 of the locking arm 16 in a state where its one end is located between the locking arm 16 and the body 15 and its other end is located between the locking arm 16 and the peripheral wall 24.

The attaching portion 28 is successive to the above one end of the member body 25. The attaching portion 28 includes a first extending segment 31, a second extending segment 32 and a locking rug 33 so that they form a shape when viewed from the side. The first extending segment 31 extends by the thickness of the second bar member 21*a* outwardly of the male housing 3 from the above one end. The second extending segment 32 extends toward the opening 18 in parallel to the member body from the end far from the member body 25 of the first extending segment 31. The second extending segment 32 is longer than the width of the width of the second bar member 21*a*. The locking lug 33 extends toward the member body 25 from the end of the second extending segment 32 close to the opening 18.

The attaching segment 28 is attached to the locking arm 16 in a state where the locking lug 33 invades the inside of the locking hole 36 and the second bar member 21*a* is accommodated between the locking lug 33 and the first and second extending segments. Therefore, the attaching segment 28 (locking assuring member 4) is slidably supported by the locking arm 16 between the point (shown in FIG. 12 and referred to as a limiting position) where the first extending segment 31 is in contact with the second bar member 21*a* and the position (shown in FIG. 14 and referred to an allowable position) where the locking lug 33 is in contact with the second bar member 21*a*. When the attaching segment 28 is attached to the locking arm 16, the second extending segment 32 is exposed to the outside through the recess 19.

At the limiting position, the locking lug 33 is apart from the second bar member 21, and at the permissible position, the first extending segment 31 is apart from the second bar segment 21*a*. Further, at the limiting position, the attaching segment 28 is flush with or slightly sinks from the outer face farthest from the female housing 2 of the male housing 3. At the permissible position, the attaching segment 28 protrudes from the outer face of the male housing 3 farthest from the female housing 2.

The contact segment 30 is attached to the other end of the member body 25 close to the opening 18. The contact segment 30 extends from the other end toward the body 15. At the limiting position, the contact segment 30 is apart from the second bar member 21*b* of the pair of second bar members 21*a* and 21*b* close to the opening 18. At the permissible position, the contact segment 30 is in contact with the second bar 21*b* close to the opening 18. Owing to the provision of the above attaching segment 28 and the contact segment 30, the locking assuring member 4 which is slidably supported by the locking arm 16 does not come off from the locking arm 16. In other words, the locking assuring member 4 is prevented from approaching the female housing 2 further from the limiting position and from leaving the female housing 2 further from the permissible position.

A face 34 (hereinafter referred to as "contact face") of the contact 30 close to the opening 18 is flat. The contact face 34 is orthogonal to the direction where the housings approach each other. The contact face 34 is in contact with the locking protrusion 5 of the female housing 2 between the above limiting position and the permissible position when the housings 2 and 3 are coupled with each other.

The protrusion 29 is provided at the center in the longitudinal direction of the member body 25. The protrusion 29 extends toward the above peripheral wall 24 from the member body 25. At the permissible position, the protrusion 29 is in contact with the inner face 24 of the peripheral wall 24 or opposite thereto. At the permissible position, the protrusion 29 is exposed through the recess 19.

The width of the one end of the member body 25 is approximately equal to that between the lugs 26. The member body 25 is provided with a pair of convex pieces 35 at the one end. As seen from FIG. 10, the convex pieces 35 project outwardly from both edges in the width direction of the member body 25. As indicated by two-dot chain line in FIGS. 18 and 19, the convex pieces 35 each has a first slope 37 and a second slope 38.

The first slope 37 is formed at the end of the convex piece 35 far from the opening 18, i.e. close to the outside of the male housing 3. The first-slope 37 slopes relatively to both longitudinal and width directions of the member body 25 so that the first slope 37 gradually approaches the body member 25 as it leaves from the opening 18, i.e. goes toward the outside of the male housing 3. As seen from FIG. 19, at the limiting position, the first slope 37 is opposite to the lug 26.

The second slope 38 is formed at the end of the convex piece 35 close to the opening 18, i.e. close to the inside of the male housing 3. The second slope 38 slopes relatively to both longitudinal and width directions of the member body 25 so that the second slope 38 gradually approaches the body member 25 as it approaches the opening 18, i.e. goes toward the inside of the male housing 3. As seen from FIG. 18, at the permissible position, the second slope 38 is opposite to the lug 26. Incidentally, the pair of lugs 26 and the pair of convex pieces 35 constitute a position holding means.

Figure 19:
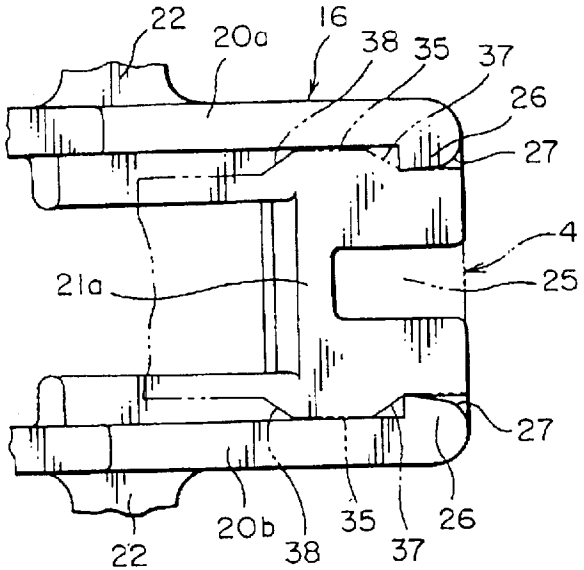
FIG. 19 is a view for schematically explaining the relative positions of lugs and convex pieces at the limiting position in the waterproof connector shown in FIG. 1.
Figure 20:
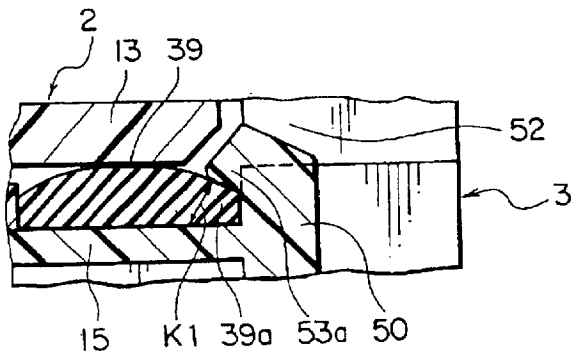
FIG. 20 is a sectional view of a packing, protrusion, etc. in the state where the female housing and male housing of the waterproof connector shown in FIG. 1 have been coupled with each other.

At the limiting position, as seen from FIG. 19, the first slope 37 is opposite to the lug 26 and the convex pieces 35 are located between the first bar members 20*a* and 20*b*, i.e. inside the locking arm 16. When the locking assuring member 4 is shifted toward the outside of the male housing 3, the first slopes 37 are brought into contact with the lugs 26, respectively. Then, the locking arm 16 is elastically deformed so that the interval between the first bar members 20*a* and 20*b* is increased, thereby providing elastic restoring force. When the lugs 26 go beyond the convex pieces 35, as the second slopes 37 become opposite to the slope 27 of the lug 26 (permissible position), thereby loosing the elastic restoring force When the locking assuring member 4 is shifted from the permissible position toward the limiting position, the locking arm 16 is once elastically deformed so that the interval between the first bar members 20*a* and 20*b* is increased, thus acquiring the elastic restoring force. When the locking assuring member 4 is shifted to the limiting position, the elastic restoring force of the locking arm 15 is lost. In this way, when the locking assuring member 4 is shifted from the limiting position to the permissible position and vice versa, owing to provision of the lugs 26 and the convex pieces 35, the locking arm 16 is elastically deformed, thus acquiring the elastic restoring force. Therefore, resistance attendant to the elastic restoring force is produced.

Thus, the lugs 26 and convex pieces 35 imparts sense of clicking to the locking assuring member 4 when shifted from the limiting position to the permissible position and vice versa. Further, the lugs 26 and the convex pieces 35 hold the locking assuring member 4 located at the limiting position, and at the permissible position as they are. The lugs 26 and the convex pieces 35 are locked to each other between the limiting position and the permissible position by the slopes 37 and 38.

At the limiting point, the protrusion 29 is in contact with or opposite to the inner face of the peripheral surface 24. Therefore, the other end of the member body 25 close to the opening 18 is limited so that it is not shifted toward the outside of the male housing 3. Thus, the elastic deformation of the locking arm 16 is limited. In this way, at the limiting position, the locking assuring member 4 limits the elastic deformation of locking arm 16.

At the permissible position, the protrusion 29 is exposed to the outside of the male housing 3 through the recess 19.

Therefore, the terminal of the member body 25 close to the opening 18 is permitted to shift toward the outside of the male housing 3. Thus, the elastic deformation of the locking arm 16 is permitted. In this way, the locking assuring member 4 permits the elastic deformation of the locking arm 16.

Figure 7:
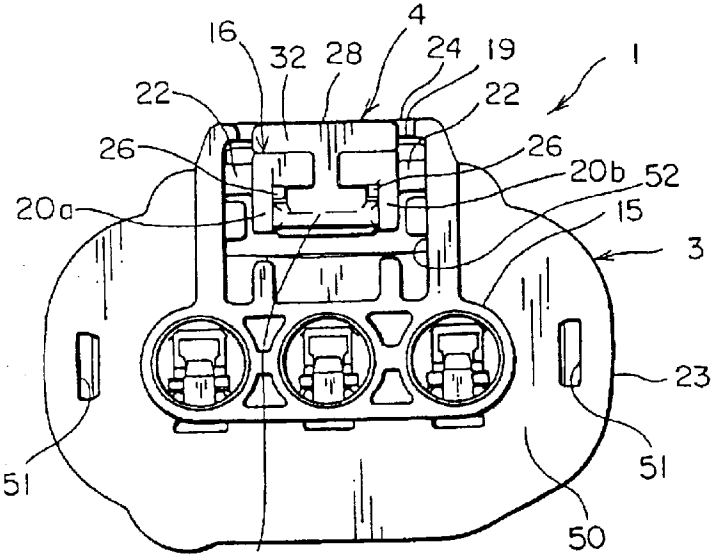
FIG. 7 is a rear view of a male housing when the locking assuring member of the waterproof connector shown in FIG. 1 is located at a limiting position.
Figure 9:
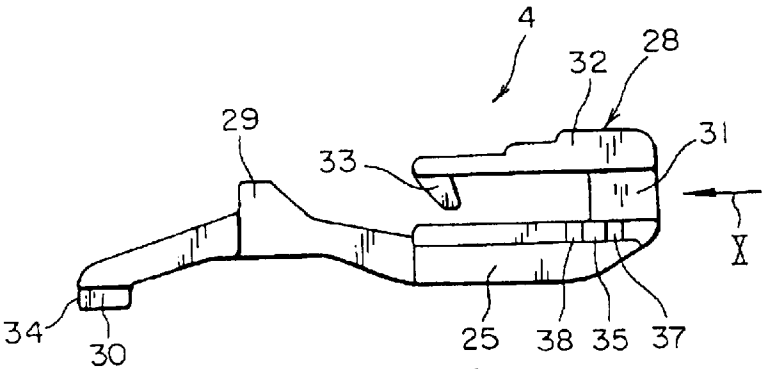
FIG. 9 is a side view of the locking assuring member of the waterproof connector shown in FIG. 1.

When the water-proof connector 1 having the structure as described above is assembled, before the male housing 2 and female housing 3 are coupled to each other, the locking assuring member 4 is preferably located at the limiting position as indicated in FIGS. 7 and 12. In order to couple the male housing 2 and female housing 3 with each other, as shown in FIGS. 1 and 12, the opening of the cover 11 and the opening 18 of the cover 23 are made opposite to each other. At this time, the opening of the cover 11 is opposite to the body 15.

Figure 13:
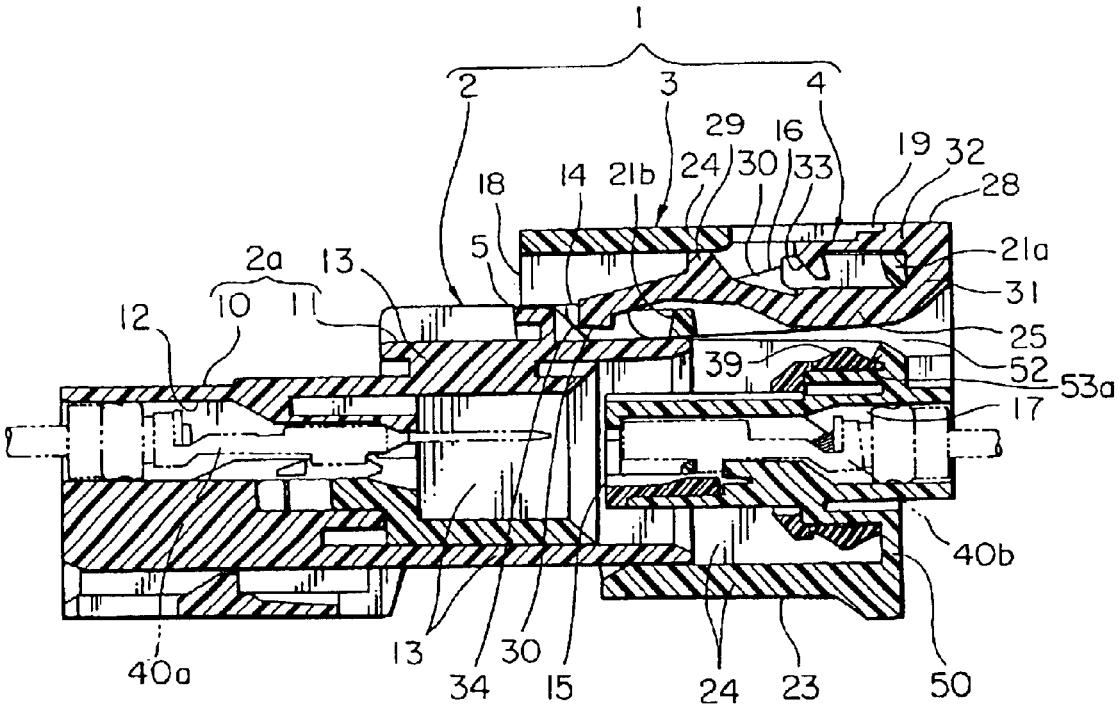
FIG. 13 is a sectional view of the female housing and male housing when the coupling therebetween is started from the state shown in FIG. 12.

As the body 15 is gradually inserted into the cover 11, the female housing 2 is gradually inserted into the cover 23. Then, as shown in FIG. 13, the tapered face 14 of the locking protrusion 5 is brought into contact with the contact face 34 or contact portion 30 of the locking assuring member 4.

Figure 8:
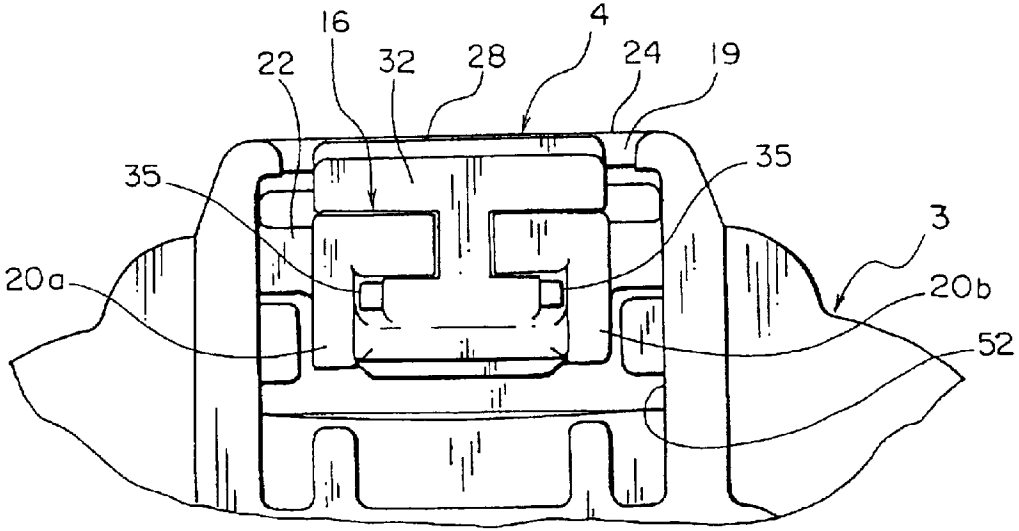
FIG. 8 is a rear view of a male housing when the locking assuring member of the waterproof connector shown in FIG. 1 is located at a permissible position.
Figure 14:
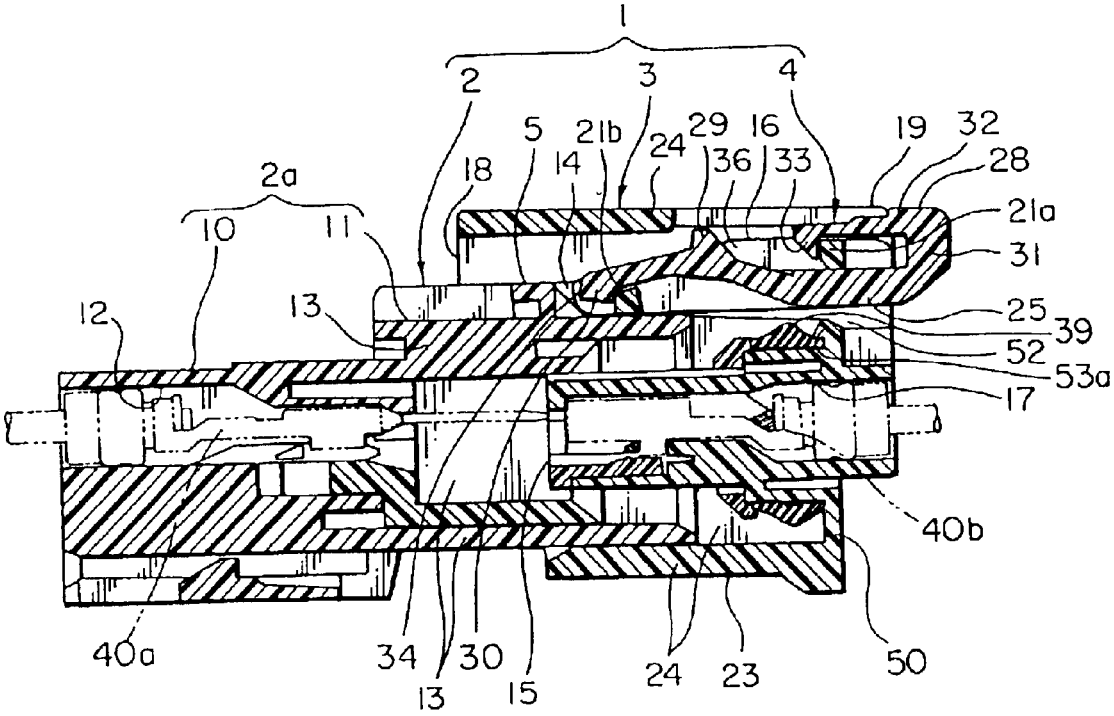
FIG. 14 is a sectional view of the male and female housings in a state where the locking assuring member has shifted to the permissible position from the state shown in FIG. 13.

As the body 15 is further inserted into the cover 11 and the female housing 2 is further inserted into the cover 23, since the protrusion 29 is opposite to the inner face of the peripheral wall 24, the locking assuring member 4 slides toward the permissible position. The locking arm 16 is elastically deformed in a direction of once extending the interval between the first bar members 20*a* and 20*b*, and the lugs climb the convex pieces 35 so that the locking assuring member 4 is shifted as shown in FIGS. 8 and 14. Thus, the protrusion 29 is exposed through the recess 19 so that the locking arm 16 becomes freely elastic.

Figure 15:
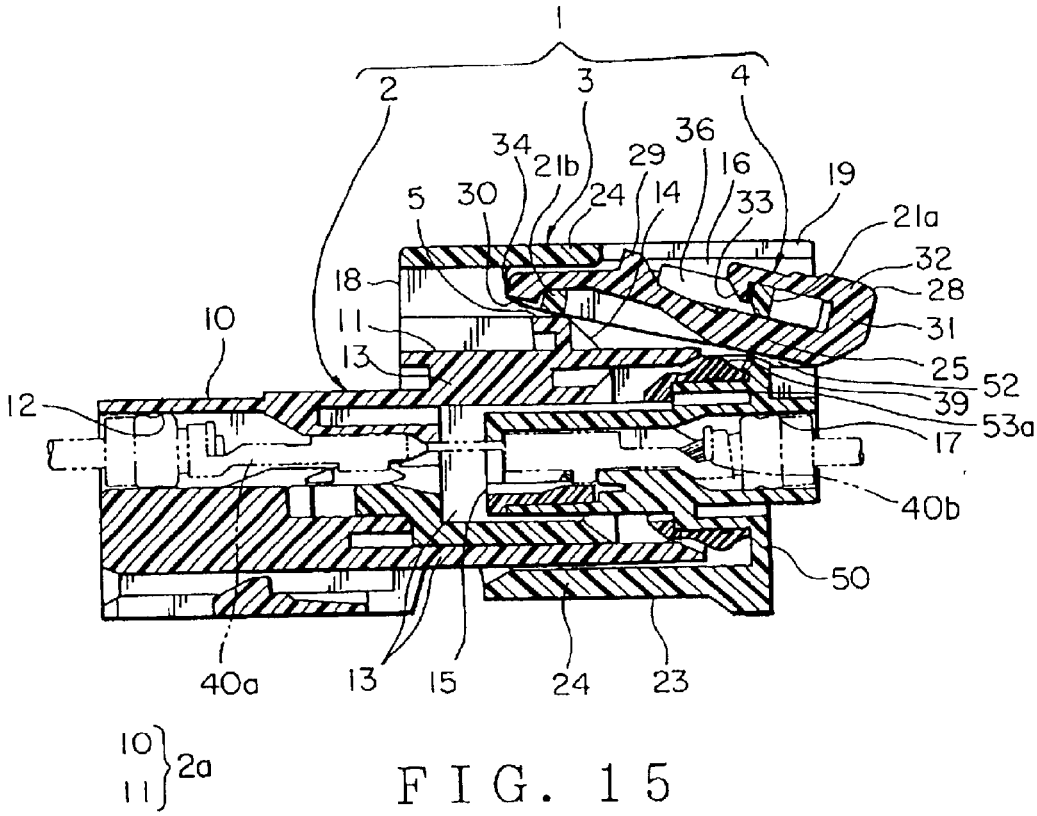
FIG. 15 is a sectional view of the male and female housings in a state where the locking assuring member and the locking arm been elastically deformed from the state shown in FIG. 14.

As the body 15 is further inserted into the cover 11 and the female housing 2 is further inserted into the cover 23, the contact portion 30 and the second bar member 21*b* close to the opening 18 are guided by the tapered face 14 to shift to the outside of the male housing 3. Incidentally, the member body 25 of the locking assuring member 4 and the locking arm 16 have been elastically deformed in the direction where the contact piece 30 or the other end of the member body 25 close to the opening 18 and the second bar member 21*b* approach the peripheral wall 24. Then, as shown in FIG. 15, the contact piece 30 and the second bar member 21*b* climb on the locking protrusion 5.

In this way, until the locking arm 16 and the locking protrusion 5 are locked to each other when the female housing 2 and male housing 3 are coupled with each other, the locking assuring member 4 shifts from the limiting position toward the permissible position in a direction leaving the female housing 2. In this case, the locking assuring member 4 is located at the permissible position, the attaching portion 28 is protruded from the outside of the male housing 3.

Figure 16:
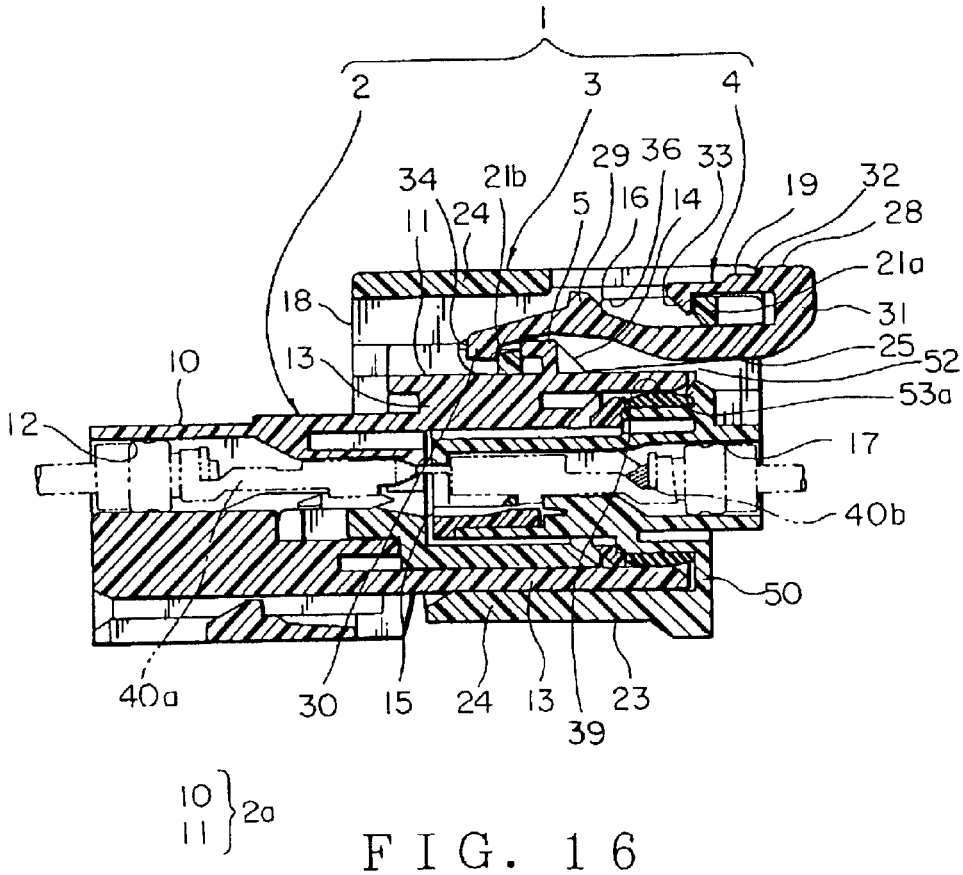
FIG. 16 is a sectional view of the male and female housings in a state where a locking protrusion has been engaged in a locking hole of the locking arm.

As the body 15 is further inserted into the cover 11 and the female housing 2 is further inserted into the cover 23, the contact portion 30 and the second bar member 21*b* climb over the locking protrusion 5 so that the locking protrusion 5 invades the locking hole 36. Then, owing to the elastic restoring force of the locking arm 16 and the member body 25, as shown in FIG. 16, the locking protrusion 5 is engaged in the locking hole 36.

Figure 17:
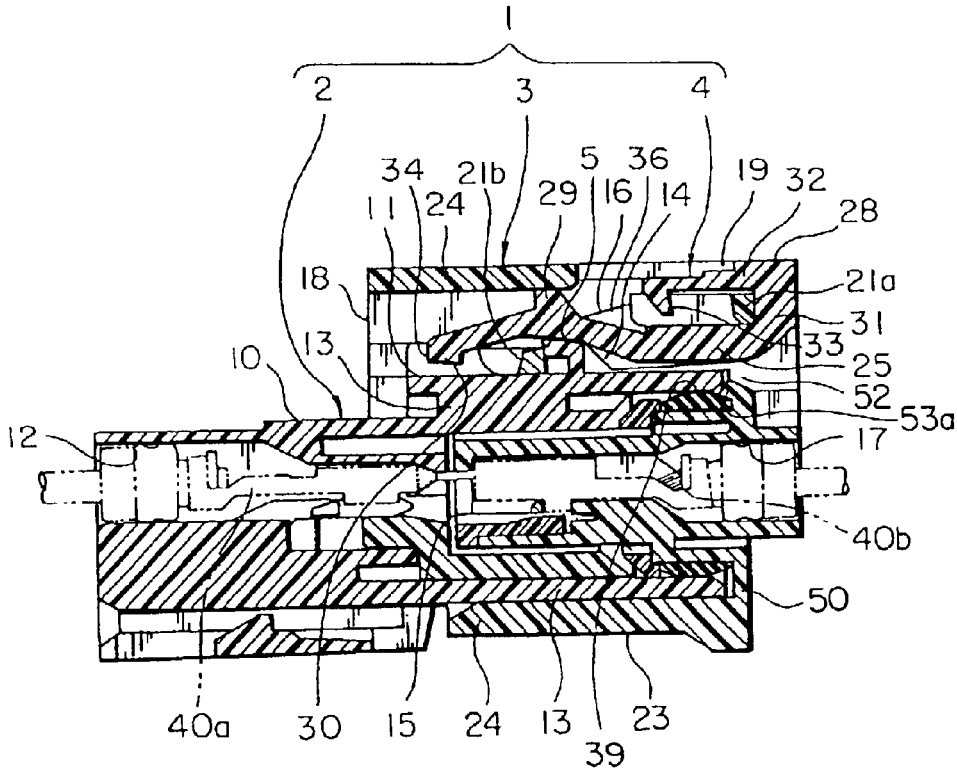
FIG. 17 is a sectional view of the male and female housings in a state where the locking assuring member has been shifted to the limiting position from the state shown in FIG. 16.
Figure 17:
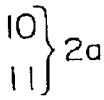
Figure 18:
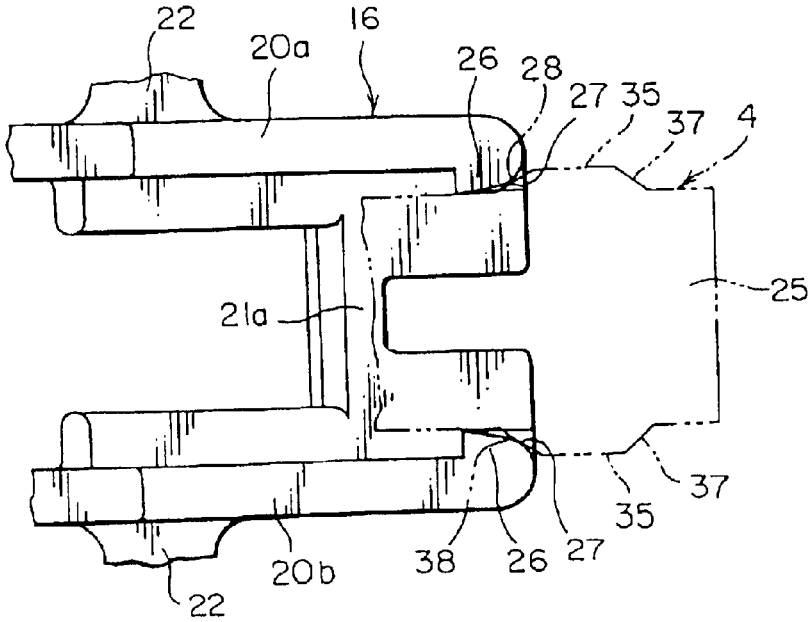
FIG. 18 is a view for schematically explaining the relative positions of lugs and convex pieces at the permissible position in the waterproof connector shown in FIG. 1.
Figure 21:
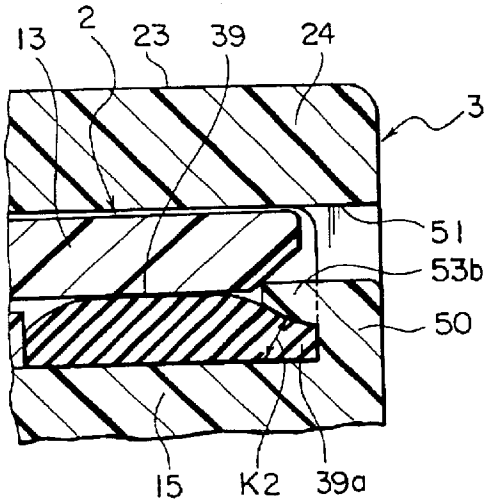
FIG. 21 is another sectional view of a packing, protrusion, etc. in the state where the female housing and male housing of the waterproof connector shown in FIG. 1 have been coupled with each other.

Thus, in the state where the locking assuring member 4 is located at the limiting position, when the female housing 2 and male housing 3 are coupled with each other, the locking assuring member 4 is shifted to the permissible position. Thereafter, the locking assuring member 4 is shifted toward the female housing 2. Then, the locking arm 16 is once elastically deformed in the direction of extending the interval between the first bar members 20*a* and 20*b*. The locking assuring member 4 is located at the limiting position as shown in FIG. 17. Thus, the male terminal 40*a* and the female terminal 40*b* are electrically connected to each other.

In order to decouple the female housing 2 and male housing 3 from each other, the locking assuring member 4 is shifted from the limiting position toward the permissible position. Thereafter, the attaching portion 28 is pushed downward in FIG. 16 so that the locking arm 16 and the locking assuring member 4 are elastically deformed, thereby causing the second bar member 21*b* and contact portion 30 to leave the peripheral wall 13 of the female housing 2. Thus, the locking protrusion 5 is caused to go out from the locking hole 36. The female housing 2 and male housing 3 are moved in a direction where they leave each other. Thus, they are decouple from each other.

Where the female housing 2 and male housing 3 are incompletely coupled with each other, i.e. as shown in FIG. 15, the contact portion 30 and second bar member 21*b* climb on the locking protrusion 5 so that the locking protrusion 5 is not engaged in the locking hole 36, the protrusion 29 is in contact with the edge of the recess 19 and hence the locking assuring member 4 cannot be moved to the limiting position. In this way, by confirming whether or not the locking assuring member 4 can be moved toward the limiting position, it is possible to know whether or not the housings 2 and 3 have been surely coupled with each other.

In the state where the housings 2 and 3 have been coupled with each other, the protrusion 29 of the locking assuring member 4 and the inner face of the peripheral wall 24 of the male housing 3 are opposite to, or in contact with each other. The protrusion 29 limits the deformation of the member body 25 and locking arm 16 in the direction of releasing the engagement between the locking protrusion 5 and the locking arm 16. Therefore, the locking assuring member 4 is located at the limiting position and the housings 2 and 3 are coupled with each other. In this state, even if it is intended that the housings 2 and 3 are caused to leave each other, the locking protrusion 5 remains engaged in the locking hole 36. Accordingly, where the locking assuring member 4 is located at the limiting position, the housings 2 and 3 do not inadvertently come off from each other.

Further, in the state where the housings have been coupled with each other, if the locking assuring member 4 located at the limiting position is moved in a direction where the locking assuring member 4 leaves the female housing 2, the protrusion 29 does not hinder the locking assuring member 4 from shifting. For this reason, the locking assuring member 4 can be smoothly moved to the permissible position. Accordingly, by shifting the locking assuring member 4 from the limiting position to the permissible position, the housings 2 and 3 can be easily taken off from each other.

In accordance with this embodiment, the hole 51 and recess 52 communicate the space inside the cover 23 with the outside thereof. Therefore, the liquid such as water permeated into the cover 23 of the male housing 3 can be surely relieved outside the male housing 3 through the hole 51 and recess 52.

The protrusions 53*a* and 53*b* protrude from the inner edge of the recess 52 and the hole 51 close to the packing 39 toward the female housing 2. The protrusions 53*a* and 53*b* are arranged between the recess 52 and hole 51, and the packing 39. Therefore, the liquid such as water permeated into the male housing 3 through the recess 52 and hole 51 does not directly bump the packing 39. Thus, watertightness is surely kept between the body 15 and the female housing 2, thereby surely preventing the liquid such as water from permeating into the contact portion between the terminals 40*a* and 40*b*.

Further, at least the one end 39*a* of the packing 39 close to the wall 50 is located between the protrusions 53*a*, 53*b* and the body 15. The one end 39*a* constitutes a part of the packing 39. Therefore, the liquid such as water permeated into the male housing 3 through the recess 52 and hole 51 bump the protrusions 53*a*, 53*b* and does not surely directly bump the packing 39. Therefore, the watertightness is surely kept between the body 15 and the female housing 2, thereby surely preventing the liquid such as water from permeating into the contact portion between the terminals 40*a* and 40*b*.

Figure 22:
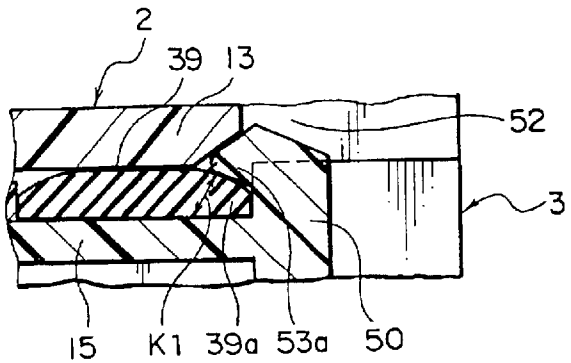
FIG. 22 is a sectional view of a modification of the protrusion and others shown in FIG. 20.

In this embodiment, when the housings 2 and 3 are coupled with each other, the protrusion 53*a* and the edge of the peripheral wall 13 of the female housing 2 are apart from and opposite to each other. However, in this invention, as shown in FIG. 22, when the housings 2 and 3 are coupled with each other, the protrusion 53*a* and the edge of the peripheral wall 13 of the female housing 2 may be brought into contact with each other.

In this case, when the housings 2 and 3 are coupled with each other, the protrusion 53*a* and the female housing 3 are brought into contact with each other so that the liquid such as water permeated into the male housing 3 through the recess 52 does not directly bump the packing 39. Therefore, the watertightness is surely kept between the body 15 and the female housing 2, thereby more surely preventing the liquid such as water from permeating into the contact portion between the terminals 40*a* and 40*b*.

Further, in the embodiment described above, the wall 50 has the hole 51 and recess 52. However, in this invention, a hole may be made in the peripheral wall 24 and a protrusion may be provided at the edge of the hole close to the packing 39. In this case, the protrusion protrudes from the inner edge of the hole toward the body 15 and is located between the hole and packing 39. Further, at least a part of the packing 39 is located between the protrusion and body 15.

Further, when the female housing 2 and male housing 3 are coupled with each other, the locking assuring member 4 is shifted from the limiting position to the permissible position. For this reason, an operator can easily recognize the locking assuring member 4, and hence does not apt to forget to shift the locking assuring member 4 toward the limiting position. Thus, it is possible to surely prevent the female and male housings from being inadvertently taken off from each other after they have been coupled with each other.

By confirming the position of the locking assuring member 4, it can be confirmed whether or not the locking arm 16 and the locking protrusion 5 have been engaged with each other. Therefore, it is possible to surely prevent the female and male housings from being inadvertently taken off from each other after they have been coupled with each other.

Further, when the female housing 2 and male housing 3 are coupled with each other, the attaching portion 28 of the locking assuring member 4 protrudes outwardly from the outside of the male housing 3. For this reason, an operator can easily recognize the locking assuring member 4, and hence does not apt to forget to shift the locking assuring member 4 toward the limiting position. Thus, it is possible to surely prevent the female and male housings from being inadvertently taken off from each other after they have been coupled with each other.

At the permissible position, the attaching portion 28 of the locking assuring member 4 protrudes. Therefore, the locking arm 16 can be easily elastically deformed through the locking assuring member 4. The engagement between the locking arm 16 and the locking protrusion 5 can be easily released. Thus, the female housing 2 and male housing 3 can be easily taken off from each other.

The pair of lugs 26 and the pair of convex pieces 35 hold the position of the locking assuring member 4. Therefore, the locking assuring member 4 shifted to the limiting position, after the female housing 2 and the male housing 3 have been coupled with each other, can be prevented from shifting to the permissible position. Accordingly, the female housing 2 and male housing 3 can be more surely prevented from inadvertently taken off from each other.

At the limiting position, since the protrusion 29 is brought into contact with the inner face of the peripheral wall 24 of the male housing 3, the member body 25 of the locking assuring member 4 and the locking arm 16 are not elastically deformed. In this way, at the limiting position, the protrusion 29 limits the elastic deformation of the locking arm 16. Therefore, when the locking assuring member 4 is located at the limiting position, the elastic deformation of the locking arm 16 is limited so that the female housing 2 and male housing 3 are prevented from being inadvertently taken off from each other.

In the state where the locking arm 16 have been elastically deformed, the protrusion 29 tends to project from the recess 19. Therefore, in the state where the locking arm 16 has been elastically deformed, the locking assuring member 4 is held at the permissible position by the protrusion 29. For this reason, it can be known whether or not the locking arm 16 and the locking protrusion 5 have been completely locked to each other, i.e. the female housing 2 and the male housing 3 have been coupled with each other.

Incidentally, the contents of Japanese Patent Appln. No. 2001-323916 filed on Oct. 22, 2001 are hereby incorporated by reference.

What is claimed is:

1. A water-proof connector composed of a connector housing and a tube-like complementary connector housing which are coupled with each other, wherein said connector housing comprises:

a tube;

a body accommodated in said tube and incorporating a terminal fitting;

a seal attached to an outer face of said body, which keeps watertight a space between an outer face of the body and an inner face of said complementary connector housing;

a first protrusion;

a second protrusion; and a third protrusion, wherein said first, second, and third protrusions are spaced apart from each other, wherein said connector housing forms a first through-hole, a second through-hole, and a recess, wherein said first through-hole, second through-hole, and recess are spaced apart from each other, wherein said first through-hole communicates a space outside said body and inside said tube with an outside of said tube and passing through said tube, wherein said second through-hole communicates a space outside said body and inside said tube with an outside of said tube and passing through said tube, wherein said recess communicates a space outside said body and inside said tube with an outside of said tube and passing through said tube, wherein said first protrusion protrudes from an inner edge of said first through-hole close to said seal toward said complementary connector housing and located between said first through-hole and said seal, wherein said second protrusion protrudes from an inner edge of said second through-hole close to said seal toward said complementary connector housing and located between said second through-hole and said seal, wherein said third protrusion protrudes from an inner edge of said recess close to said seal toward said complementary connector housing and located between said recess and said seal.

2. A water-proof connector according to claim 1, wherein when said connector housing and said complementary connector housing are in a coupled state with each other, said complementary connector housing is in contact with said first, second, and third protrusions.

3. A water-proof connector according to claim 1, wherein at least a part of said seal is located between said first protrusion and said body.

4. A connector housing for a water-proof connector to be coupled with a tube-like complementary connector housing, wherein said connector housing comprises:

a tube;

a body accommodated in said tube and incorporating a terminal fitting;

a seal attached to an outer face of said body, which keeps watertight a space between an outer face of the body and an inner face of said complementary connector housing;

a first protrusion;

a second protrusion; and a third protrusion, wherein said first, second, and third protrusions are spaced apart from each other, wherein said connector housing forms a first through-hole, a second through-hole, and a recess, wherein said first through-hole, second through-hole, and recess are spaced apart from each other, wherein said first through-hole communicates a space outside said body and inside said tube with an outside of said tube and passing through said tube, wherein said second through-hole communicates a space outside said body and inside said tube with an outside of said tube and passing through said tube, wherein said recess communicates a space outside said body and inside said tube with an outside of said tube and passing through said tube, wherein said first protrusion protrudes from an inner edge of said first through-hole close to said seal toward said complementary connector housing and located between said first through-hole and said seal, wherein said second protrusion protrudes from an inner edge of said second through-hole close to said seal toward said complementary connector housing and located between said second through-hole and said seal, wherein said third protrusion protrudes from an inner edge of said recess close to said seal toward said complementary connector housing and located between said recess and said seal.

5. A connector housing for a water-proof connector according to claim 4, wherein when said connector housing and said complementary connector housing are in a coupled state with each other, said complementary connector housing is in contact with said first, second, and third protrusions.

6. A connector housing for a water-proof connector according to claim 4, wherein at least a part of said seal is located between said first protrusion and said body.

* * * * *